US011521556B2

(12) United States Patent
Lee et al.

(10) Patent No.: US 11,521,556 B2
(45) Date of Patent: Dec. 6, 2022

(54) CHANNEL CONTROLLER AND DISPLAY DEVICE USING THE SAME

(71) Applicant: LG DISPLAY CO., LTD., Seoul (KR)

(72) Inventors: Jinwon Lee, Paju-si (KR); Suhyuk Jang, Paju-si (KR); Hyojin Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/598,562

(22) Filed: Oct. 10, 2019

(65) Prior Publication Data

US 2020/0118498 A1 Apr. 16, 2020

(30) Foreign Application Priority Data

Oct. 10, 2018 (KR) ..... 10-2018-0120725

(51) Int. Cl.
*G09G 3/3275* (2016.01)
*G09G 5/39* (2006.01)

(52) U.S. Cl.
CPC ..... *G09G 3/3275* (2013.01); *G09G 5/39* (2013.01); *G09G 2300/0413* (2013.01); *G09G 2310/0243* (2013.01); *G09G 2310/08* (2013.01); *G09G 2340/0421* (2013.01); *G09G 2370/00* (2013.01)

(58) Field of Classification Search
CPC ..... G09G 5/39–391; G09G 2340/0421; G09G 2300/0413
See application file for complete search history.

(56) References Cited

U.S. PATENT DOCUMENTS 10,614,763 B2 * 4/2020 Jeong ..... G09G 3/3275
2002/0180746 A1 * 12/2002 Yasui ..... H04N 5/66 348/E7.012
2005/0128170 A1 6/2005 Kang et al.
2006/0041805 A1 * 2/2006 Song ..... G09G 3/2011 714/724
2010/0302214 A1 * 12/2010 Kim ..... G09G 3/20 345/204
2013/0050292 A1 * 2/2013 Mizukoshi ..... G09G 3/3291 345/690
2014/0063023 A1 * 3/2014 Baek ..... G09G 1/00 345/501
2017/0092185 A1 * 3/2017 Lee ..... G09G 3/2092
2017/0213519 A1 * 7/2017 Chang ..... G09G 3/3688
2018/0226009 A1 * 8/2018 Lin ..... G09G 3/20
2019/0189047 A1 * 6/2019 Kim ..... G09G 5/005
2020/0074914 A1 * 3/2020 Wang ..... G09G 5/005

FOREIGN PATENT DOCUMENTS

KR 10-2014-0030437 A 3/2014

* cited by examiner

*Primary Examiner* — William Boddie
*Assistant Examiner* — Bipin Gyawali
(74) *Attorney, Agent, or Firm* — Birch, Stewart, Kolasch & Birch, LLP

(57) ABSTRACT

A channel control unit and a display device using the same are provided. The channel control unit can include a data driver that converts pixel data into data voltages and supplies the data voltages to data lines, and an ineffective channel controller that receives channel data, generates dummy data during an ineffective channel section indicated by the channel data, and sends the dummy data to the data driver.

17 Claims, 15 Drawing Sheets

CHANNEL CONTROLLER AND DISPLAY DEVICE USING THE SAME

CROSS-REFERENCE TO RELATED APPLICATION

This application claims the priority benefit of Korean Patent Application No. 10-2018-0120725 filed on Oct. 10, 2018, the entire contents of which is incorporated herein by reference for all purposes as if fully set forth herein.

BACKGROUND OF THE INVENTION

Field of the Invention

The present disclosure relates to a channel control unit capable of adaptively varying the number of channels in a source driver integrated circuit (IC).

Related Art

Various flat panel displays are being developed, including liquid-crystal displays (LCDs), electroluminescence displays, field emission displays (FEDs), plasma display panels (PDPs), and so on.

Electroluminescence displays are roughly classified into inorganic light-emitting displays and organic light-emitting displays depending on the material of an emission layer. Among these displays, an active-matrix organic light emitting display comprises organic light-emitting diodes (hereinafter, "OLED"), which emit light themselves, and has the advantages of fast response time, high luminous efficiency, high brightness, and wide viewing angle. Since the organic light-emitting display can display black levels as true black, it can produce images with much greater contrast ratios and higher color reproduction.

Driving circuits in a flat panel display include a data driver circuit for supplying a data signal to data lines, a gate driver circuit for supplying a gate signal (or scan signal) to gate lines (or scan lines), and so forth. The data driver circuit can be implemented as a source driver IC (integrated circuit) mounted on a COF (chip-on-film)'s base film. The COF can be bonded to a display panel by a bonding process using ACF (anisotropic conductive film), allowing its output pads to be connected to pads on data lines.

SUMMARY OF THE INVENTION

The number of channels in a driver IC is fixed, and is selected depending on the horizontal resolution of the display panel. When the horizontal resolution of the display panel is changed, the number of channels in a driver IC needs to be changed according to the changed resolution. When there are four types of display panels with different horizontal resolutions, four types of driver ICs are required which has different numbers of channels according to the horizontal resolution of each display panel.

Although a circuit for adjusting the number of channels can be added to a driver IC, the addition of the circuit and optional pins leads to an increase in the chip size of a source driver IC and higher IC costs.

The present disclosure provides a channel control unit capable of varying the number of channels in a driver IC without adding a circuit for adjusting the number of channels and optional pins to the driver IC, and a display device using the same.

An exemplary embodiment of the present disclosure provides channel control unit can comprise a data driver that converts pixel data into data voltages and supplies the data voltages to data lines, and an ineffective channel controller that receives channel data, generates dummy data during an ineffective channel section indicated by the channel data, and sends the dummy data and the pixel data to the data driver.

A display device according to the present disclosure allows a designer, manufacturer, etc. to set as many channels in each driver IC as they want by using the channel control unit, without adding a circuit for adjusting the number of channels and optional pins to the driver IC.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DESCRIPTION OF THE EMBODIMENTS

Figure 1:
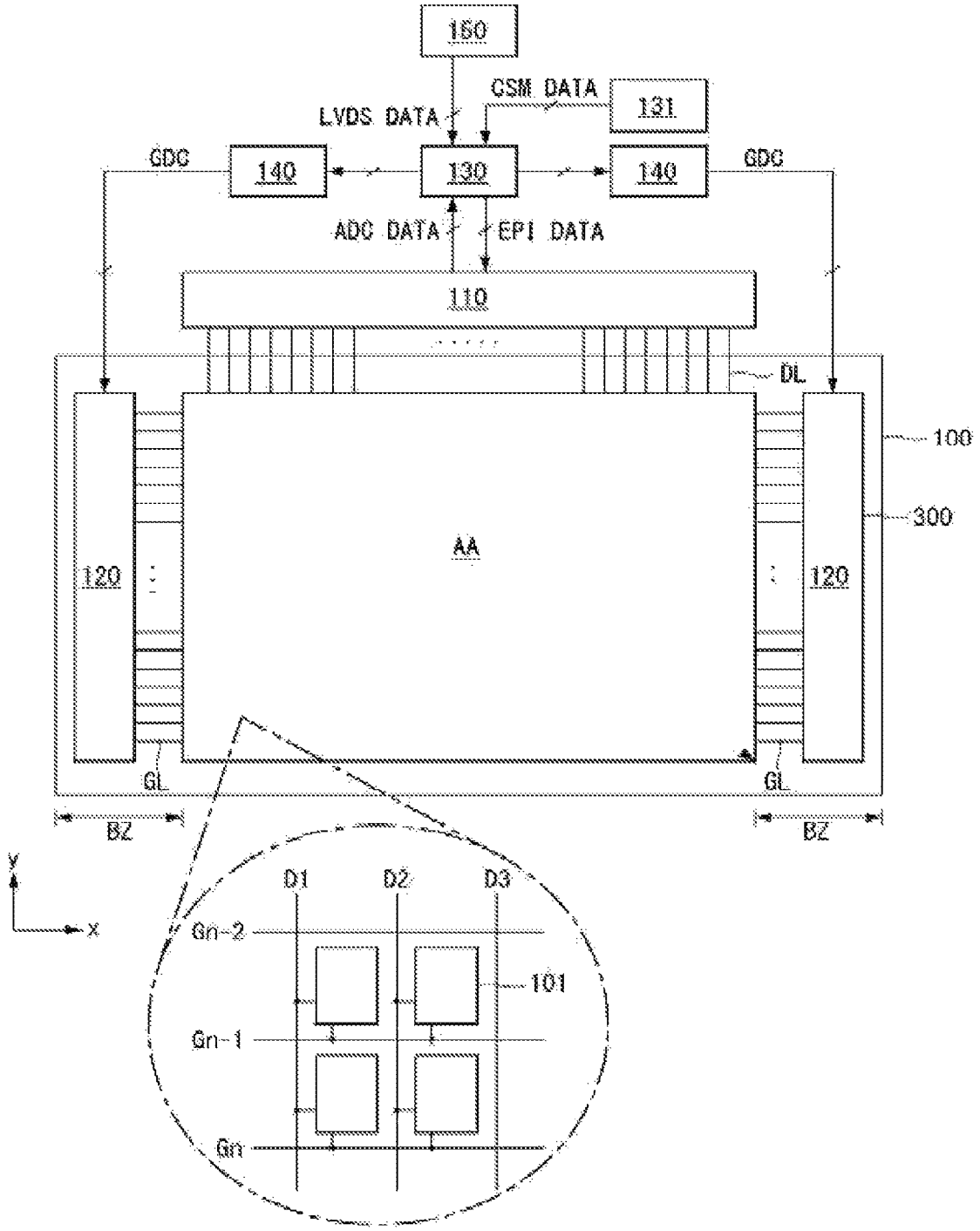
FIG. 1 is a block diagram showing a display device according to an exemplary embodiment of the present disclosure.

Various aspects and features of the present disclosure and methods of accomplishing them can be understood more readily by reference to the following detailed descriptions of exemplary embodiments and the accompanying drawings. The present disclosure can, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, proportions, angles, numbers, etc. shown in the figures to describe the exemplary embodiments of the present disclosure are merely examples and not limited to those shown in the figures. Like reference numerals denote like elements throughout the specification. In describing the present disclosure, detailed descriptions of related well-known technologies will be omitted to avoid unnecessary obscuring the present disclosure.

When the terms 'comprise', 'have', 'consist of' and the like are used, other parts can be added as long as the term 'only' is not used. The singular forms can be interpreted as the plural forms unless explicitly stated.

The elements can be interpreted to include an error margin even if not explicitly stated.

When the position relation between two parts is described using the terms "on", "over", "under", "next to" and the like, one or more parts can be positioned between the two parts as long as the term "immediately" or "directly" is not used.

It will be understood that, although the terms first, second, etc., can be used to distinguish one element from another element, the functions or structures of these elements should not be limited by these terms.

The features of various exemplary embodiments of the present disclosure can be coupled or combined with one another either partly or wholly, and can technically interact or work together in various ways. The exemplary embodiments can be carried out independently or in connection with one another.

Hereinafter, various exemplary embodiment of the present disclosure will be described in detail with reference to the accompanying drawings. It should be noted that, although an organic light-emitting display will be described in the following exemplary embodiments, the present disclosure is not limited to them. The present disclosure can be applicable to other types of display devices other than organic light-emitting displays as long as they need to change the number of channels in a display panel drive circuit in accordance with different resolutions of the display panel.

FIG. 1 is a block diagram showing a display device according to an exemplary embodiment of the present disclosure. All components of the display device according to all embodiments of the present disclosure are operatively coupled and configured.

Referring to FIG. 1, the display device according to the exemplary embodiment of the present disclosure comprises a display panel 100 and a display panel drive circuit.

The display panel 100 comprises a pixel array AA that reproduces an input image. The pixel array AA comprises a plurality of data lines DL, a plurality of gate lines GL intersecting the data lines DL, and a plurality of pixels arranged in a matrix.

Each pixel can be divided into a red subpixel, a green subpixel, and a blue subpixel for color representation. Each pixel can further comprise a white subpixel. Each subpixel 101 comprises a pixel circuit.

Touch sensors can be placed on the display panel 100. Touch input can be sensed using touch sensors or through pixels. The touch sensors can be implemented as on-cell type- or add-on type touch sensors which are placed on the screen of the display panel, or as in-cell type touch sensors which are embedded in the pixel array.

The display panel drive circuit comprises a data driver 110 and a gate driver 120. The display panel drive circuit writes pixel data of an input image to pixels on the display panel 100 under control of a timing controller (TCON) 130.

The data driver 110 converts pixel data EPI DATA of an input image, received from the timing controller 130, into analog gamma-compensated voltages by using a digital-to-analog converter (hereinafter, "DAC") to produce pixel data voltages through effective channels. The effective channels in the data driver 110 are electrically connected to the data lines DL to supply the pixel data voltages to the data lines DL. Each sub-pixel is supplied with a pixel data voltage through the data lines DL. Each sub-pixel's pixel circuit can comprise a TFT (thin-film transistor) between a data lines and the sub-pixel, that switches the pixel data voltage.

Figure 9:
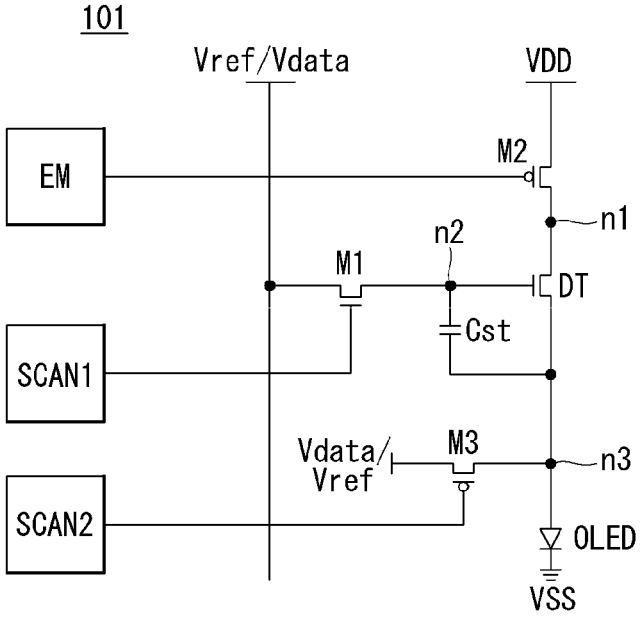
FIG. 9 is a circuit diagram showing an example of a pixel circuit according to an example of the present disclosure.

The gate driver 120 can be formed in a bezel area on the display panel 100, where no image is displayed. The gate driver 120 outputs a gate signal under control of the timing controller 130 to select pixels to charge with data voltages through gate lines GL. The gate driver 120 outputs a gate signal and shifts the gate signal by using a shift register. The gate signal can comprise an emission control signal (hereinafter, "EM signal") and scan signals SCAN1 and SCAN2 as shown in FIG. 9.

The timing controller 130 sends pixel data (digital data) of an input image to effective channels in the data driver 110, and sends dummy data, which is set regardless of the pixel data of input image, to ineffective channels in the data driver 110. The dummy data is set separately from the pixel data.

The timing controller 130 receives pixel data LVDS DATA of an input image and a timing signal synchronized with it from a host system 150. The timing signal comprises a vertical synchronization signal Vsync, a horizontal synchronization signal Hsync, a clock signal DCLK, and a data enable signal DE. Each cycle of the vertical synchronization signal Vsync corresponds to 1 frame. Each cycle of the horizontal synchronization signal Hsync and data enable signal DE corresponds to 1 horizontal period 1H. A pulse of the data enable signal DE defines the duration of pixel data to be displayed on pixels. Since frame periods and horizontal periods can be determined by counting data enable signals DE, the vertical synchronization signal Vsync and the horizontal synchronization signal can be omitted.

The host system 150 can be one of the following: a TV (television) system, a set-top box, a navigation system, a personal computer PC, a home theater system, a mobile device, and a wearable device.

The timing controller 130 can control the operation timing of the display panel drivers 110 and 120 by multiplying the frame frequency (Hz) of an input image i times (i is a positive integer greater than 0). The frame frequency is 60 Hz in the NTSC (National Television Standards Committee) system and 50 Hz in the PAL (Phase-Alternating Line) system.

The timing controller 130 generates a data timing control signal for controlling the operation timing of the data driver 110 and a gate timing control signal GDC for controlling the operation timing of the GIP circuit 120, based on the timing signal Vsync, Hsync, and DE received from the host system 150.

The timing controller 130 is connected to a memory 131. The memory 131 can be an EEPROM (electrically erasable programmable read-only memory) in a display such as a TV or monitor, or can be a flash memory in the case of a mobile device or wearable device.

In the mobile device or wearable device, the timing controller 130, data driver 110, level shifter, and power circuits can be integrated in one driver IC.

Setting data for defining the operation timing of the display panel drive circuit is stored in the memory 131. The setting data further comprises CSM (channel sync module) data that defines an ineffective channel section for the data driver 110. The CSM data defines an ineffective channel section based on the horizontal resolution of the display panel 100 or the number of channels in the source driver IC. The CSM data comprises information on the starting position and width of the ineffective channel section. Display makers can update CSM data with setting values corresponding to the horizontal resolution of the display panel 100 or the number of channels in the source driver IC.

The level shifter 140 converts the voltage of the gate timing control signal GDC outputted from the timing controller 130 to gate-on voltage and gate-off voltage and supplies them to the gate driver 130. The low-level voltage of the gate timing control signal is converted to gate-low voltage VGL, and the high-level voltage of the gate timing control signal GDC is converted to gate-high voltage VGH.

Each of the pixels on the organic light-emitting display comprises an OLED, which is a light-emitting element, and a driving element that supplies an electric current to the OLED and drives it by a gate-source voltage Vgs. The OLED comprises an anode, a cathode, and an organic compound layer situated between these electrodes. The organic compound layer can comprise, but is not limited to, a hole injection layer HIL, a hole transport layer HTL, an emission layer EML, an electron transport layer ETL, and an electron injection layer EIL. When an electric current flows through the OLED, a hole passing through the hole transport layer HTL and an electron passing through the electron transport layer ETL move to the emission layer EML, forming an exciton. As a result, the emission layer EML generates visible light.

The driving element can be implemented as a transistor such as MOSFET (metal oxide semiconductor field effect transistor). The electrical characteristics of the driving element should be uniform for every pixel, but there can be variations between pixels due to process variation and device characteristic variation, and there can be variations with the passage of display driving time. To compensate for variations in the electrical characteristics of the driving element, internal compensation and external compensation can be applied to the organic light-emitting display.

In the internal compensation method, an internal compensation circuit embedded in each sub-pixel is used to sample the electrical characteristics of the driving element of each pixel and compensate for the gate-source voltage of the driving element by the amount of variation or temporal change in the electrical characteristics of each sub-pixel or the amount of change over time.

In the external compensation method, an external compensation circuit is used to compensate for, in real time, variation or temporal change in the electrical characteristics of each sub-pixel by sensing the current or voltage of the driving element, which varies with the electrical characteristics of the driving element, and modulating, in real time, pixel data (digital data) of an input image based on the sensed electrical characteristics of the driving element of each sub-pixel. The electrical characteristics of the driving element can include threshold voltage Vth and mobility μ.

The external compensation circuit converts a sensing result from each sub-pixel to digital data ADC DATA by using an analog-to-digital converter (hereinafter, "ADC") and sends it to a compensation part. The compensation part selects a preset compensation value according to digital data ADC DATA indicating the electrical characteristics of each sub-pixel. The compensation part compensates for changes in the electrical characteristics of each sub-pixel over time or variations in electrical characteristics between sub-pixels by modulating a pixel data of input image sent to the data driver 110 by adding the selected compensation value to the pixel data or multiplying the pixel data by the selected compensation value.

Figure 2:
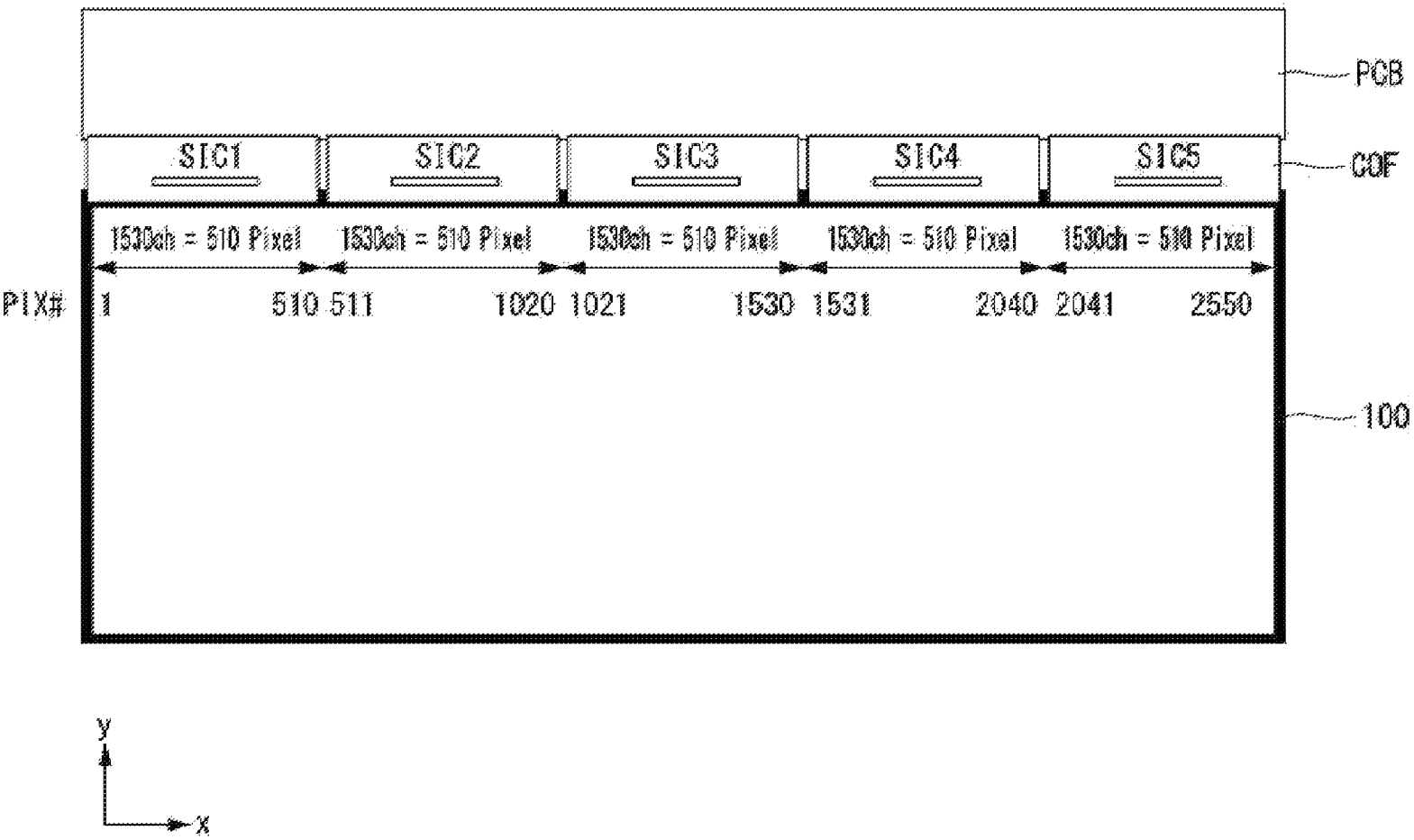
FIG. 2 is a view showing an example where five source driver ICs are connected to a display panel.

Referring to FIG. 2, the data driver 110 can be implemented as one or more source driver ICs. Each of the source driver ICs SCI1 to SIC5 can be mounted on a COF's base film. The COF where the source driver ICs SIC1 to SIC5 is bonded to the display panel 100 by a bonding process using ACF. Input pads on the COF are connected to a PCB, and output pads are connected to the pads on the data lines DL. The timing controller 130, level shifter 140, power circuit, etc. can be mounted on the PCB.

Each of the source driver ICs SIC1 to SIC5 comprises a plurality of channels. Each of the channels of the source driver ICs can be defined as ineffective channels and effective channels under control of the timing controller 130. The Ineffective channels separated from the data lines. In other words, the ineffective channels are not connected to the data lines. On the contrary, the effective channels are electrically connected to the data lines and supply a pixel data voltages to the data lines.

The ineffective channels are the source driver ICs' ineffective channels through which dummy data set regardless of pixel data of an input image are outputted. The dummy data is encoded in an ineffective channel section and sent to the source driver ICs SIC1 to SIC5 by the timing controller 130. The dummy data is set to zero and sent to the ineffective channels by the timing controller 130, but not limited to this. Since the ineffective channels are not connected to the data lines DL, dummy data voltages generated from the source driver ICs SIC1 to SIC5 are not applied to the data lines DL.

The effective channels of the source driver ICs SIC1 to SIC5 can be connected to the data lines via the output pads on the COF. The source driver ICs SIC1 to SIC5 can be bonded directly onto a substrate of the display panel 100 in a COG (chip on glass process. In this case, the effective channels of the source driver ICs can be connected to the data lines via bumps on an IC package.

A demultiplexer can be placed between the effective channels of the source driver ICs SIC1 to SIC5 and the data lines. The demultiplexer can connect the effective channels of the source driver ICs to the data lines under control of the timing controller 130. The demultiplexer time-divides a pixel data voltage outputted from the data driver 110 and distributes it to data lines DL by using a plurality of switching elements. Since a pixel data voltage outputted from one channel of the data driver is time-divided and distributed to a plurality of data lines, the number of channels in the data driver 110 can be reduced.

If there are N channels in each of the source driver ICs SIC (N is a natural number, preferably N is equal to or greater than 2), each of the N channels operates as an effective channel or ineffective channel under control of the timing controller 130.

In the following exemplary embodiment, each of the source driver ICs SIC to SIC5 is described as having 1,536 channels, but the present disclosure is not limited to this. In a case where pixel data comprises red, green, and blue data, 1 pixel data is supplied to three sub-pixels through three data lines. Since 1,536 effective channels are connected to 1,536 data lines, they supply red, green, and blue data simultaneously to 512 pixels and deal with the 512 pixels.

In the example shown in FIG. 2, 1,530 effective out of 1,536 channels in each of the source driver ICs SIC1 to SIC5 are connected to data lines DL and supply pixel data voltages simultaneously to 510 pixels arranged along 1 horizontal line x on the display panel 100. In the example shown in FIG. 2, the timing controller 130 controls six channels in each of the source driver ICs SIC1 to SIC5 as ineffective channels through which dummy data is sent.

FIG. 2 shows an example in which five source driver ICs SIC1 to SIC5 are connected to a display panel 10 with a 2550×1440 resolution. In FIG. 2, PIX # denotes pixel data numbers. With the horizontal resolution of 2550, the number of data lines on the display panel 100 is 2,550*3=7,650. Each of the source driver ICs SIC1 to SIC5 has 1,530 effective channels out of the 1,536 channels, under control of the timing controller 130. Thus, the total number of effective channels in the source driver ICs SIC to SIC5 is 7,650.

These five source driver ICs SIC1 to SIC5 are connected to the display panel 100 with a horizontal resolution of 2550. A first effective channel of the first source driver IC SIC1 is connected to a first data line at the leftmost end, and the last effective channel of the fifth source driver IC SIC5 is connected to the last data line, i.e., 7650th data line, at the rightmost end. As in the example of FIG. 3, the left and right bezels of the display panel 100 become slimmer in width and equal in size as an ineffective channel section is arranged between each effective channel section for the source driver ICs SIC to SIC5.

Here's an example that gives four options to vary the number of effective channels in the source driver ICs, which will be described in conjunction with FIGS. 3 to 8.

Figure 3:
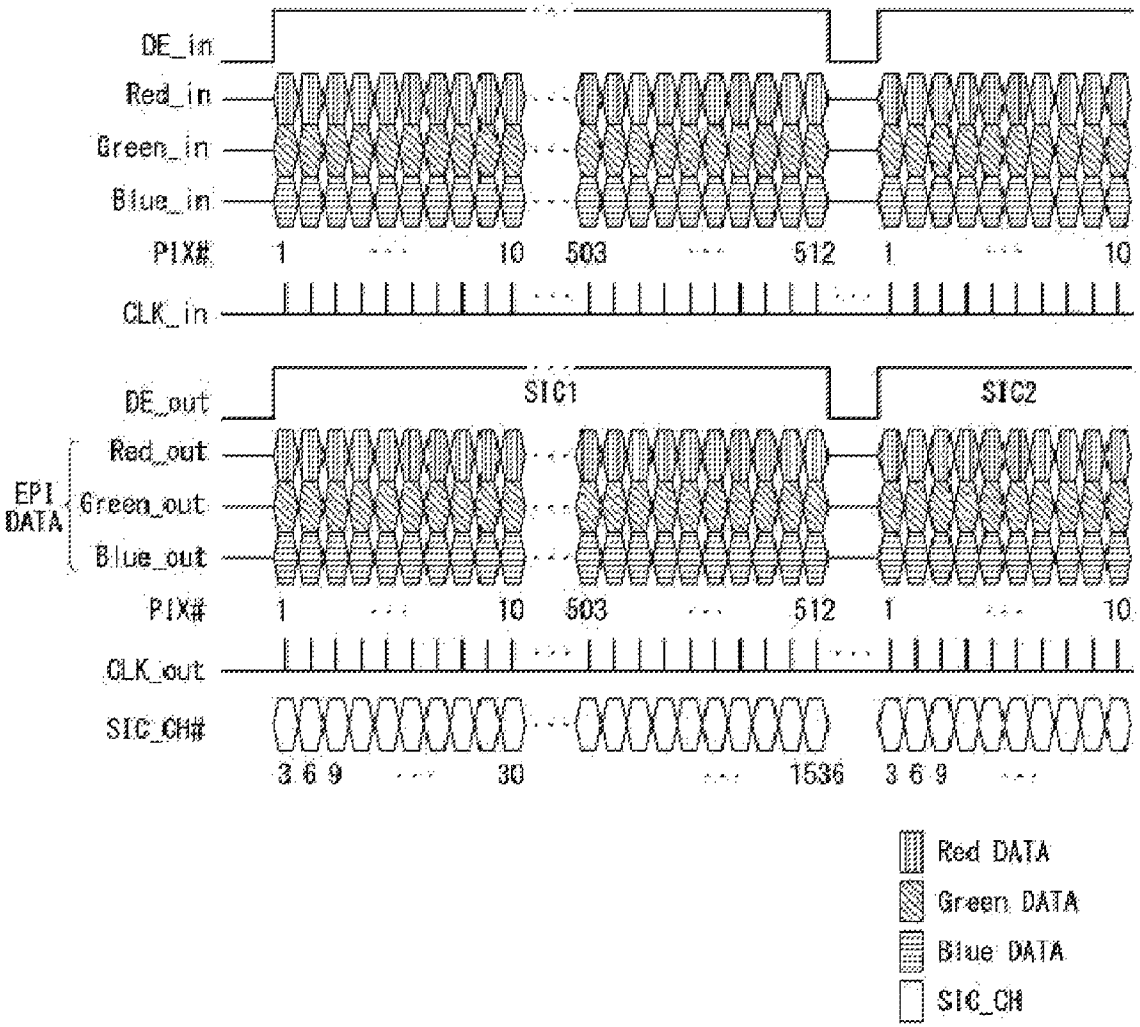
FIG. 3 is a waveform diagram showing input and output signals of a timing controller in an example where five source driver ICs are connected to a display panel with a 2560×1200 resolution.

FIG. 3 shows input and output signals of the timing controller in an example where five source driver ICs SIC1 to SIC5 are connected to a display panel 100 with a 2560×1440 resolution.

Referring to FIG. 3, if there are five source driver ICs SIC1 to SIC5 each having 1,536 channels, the total number of channels is 7,680. With the horizontal resolution of 2560, the number of data lines on the display panel 100 is 2,560*3=7,680. Thus, if five source driver ICs SIC1 to SIC5 are connected to a display panel 100 with the horizontal resolution of 2560, the timing controller 130 controls all the channels in the source driver ICs SIC1 to SIC5 as effective channels. In the example of FIG. 3, all the channels in the source driver ICs SIC1 to SIC5 operate as effective channels without comprising any ineffective channel, and output pixel data voltages.

In FIG. 3, DE_in is a first data enable signal inputted to the timing controller 130. Red_in, green_in, and Blue_in represent red data, green data, and blue data, respectively, that are inputted to the timing controller 130 in synchronization with the first data enable signal DE_in. CLK_in is a first clock inputted to the timing controller 130. The timing controller 130 samples input pixel data Red_in, Green_in, and Blue_in and writes it to an internal memory, in accordance with the first clock CLK_in from the host system 150.

Figure 4:
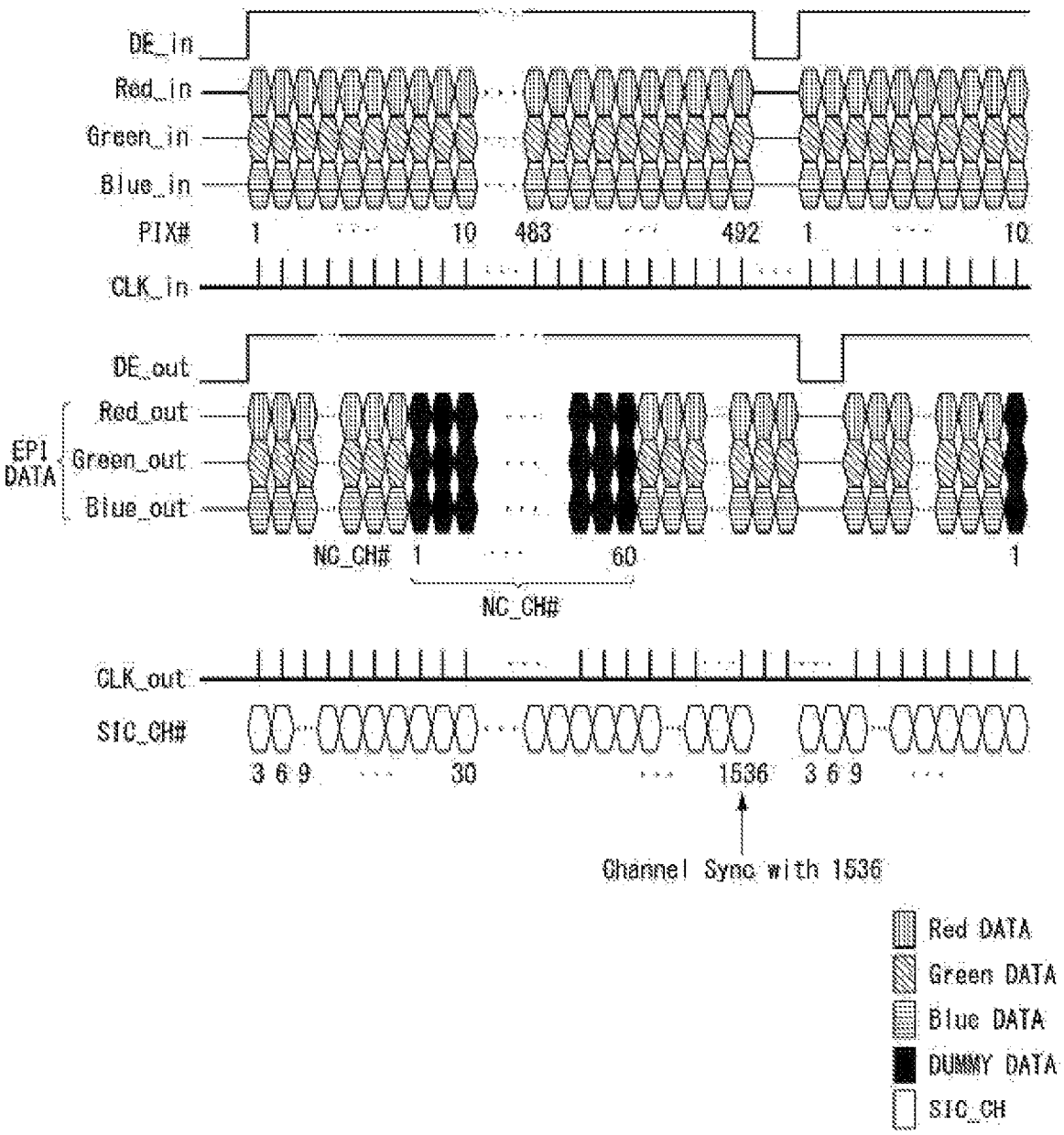
FIG. 4 is a waveform diagram showing input and output signals of a timing controller in an example where five source driver ICs are connected to a display panel with a 2460×1200 resolution.

In FIG. 4, DE_out is a second data enable signal generated in the timing controller 130. Red_in, Green_in, and Blue_in represent red data, green data, and blue data, respectively, that are outputted from the timing controller 130 in synchronization with the second data enable signal DE_out. CLK_out is a second clock generated by an oscillator in the timing controller 130. The timing controller 130 reads pixel data Red_out, Green_out, and Blue_out from the internal memory and sends it to the source driver ICs SIC1 to SIC5, in accordance with the second clock CLK_out. SIC_CH # denotes channel numbers of the source driver ICs SIC1 to SIC5.

Figure 6:
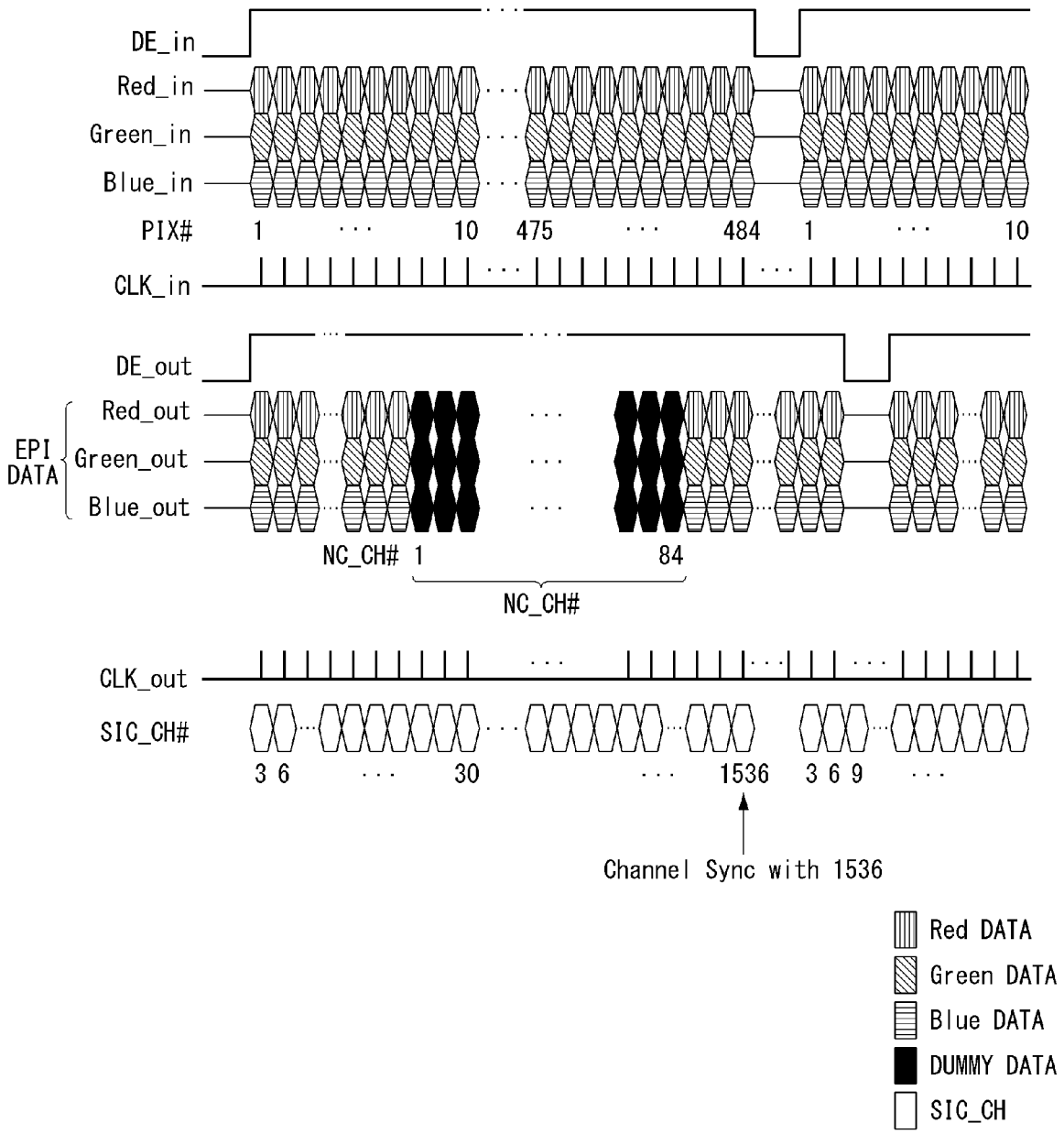
FIG. 6 is a waveform diagram showing input and output signals of a timing controller in an example where five source driver ICs are connected to a display panel with a 2416×1200 resolution.

Data for 1,536 channels of each source driver IC is transmitted in one pulse of the second data enable signal DE_out. When an ineffective data section is set by the timing controller 130, dummy data to be sent to the ineffective data section is added, thus increasing the pulse width of the second data enable signal DE_out by that much. Thus, if the number of effective channels changes with the varying ineffective channel section for the source driver ICs, the second data enable signal DE_out is changed as shown in FIGS. 4 and 6. The timing controller 130 outputs data corresponding to the total number of channels in each of the source driver ICs SIC1 to SIC5 within the width of 1 pulse of the second data enable signal DE_out, regardless of the presence or absence of an ineffective channel section and regardless of the length of the ineffective channel section. The data herein comprises pixel data and dummy data that are transmitted with the width of 1 pulse of the second data enable signal DE_out.

Figure 5:
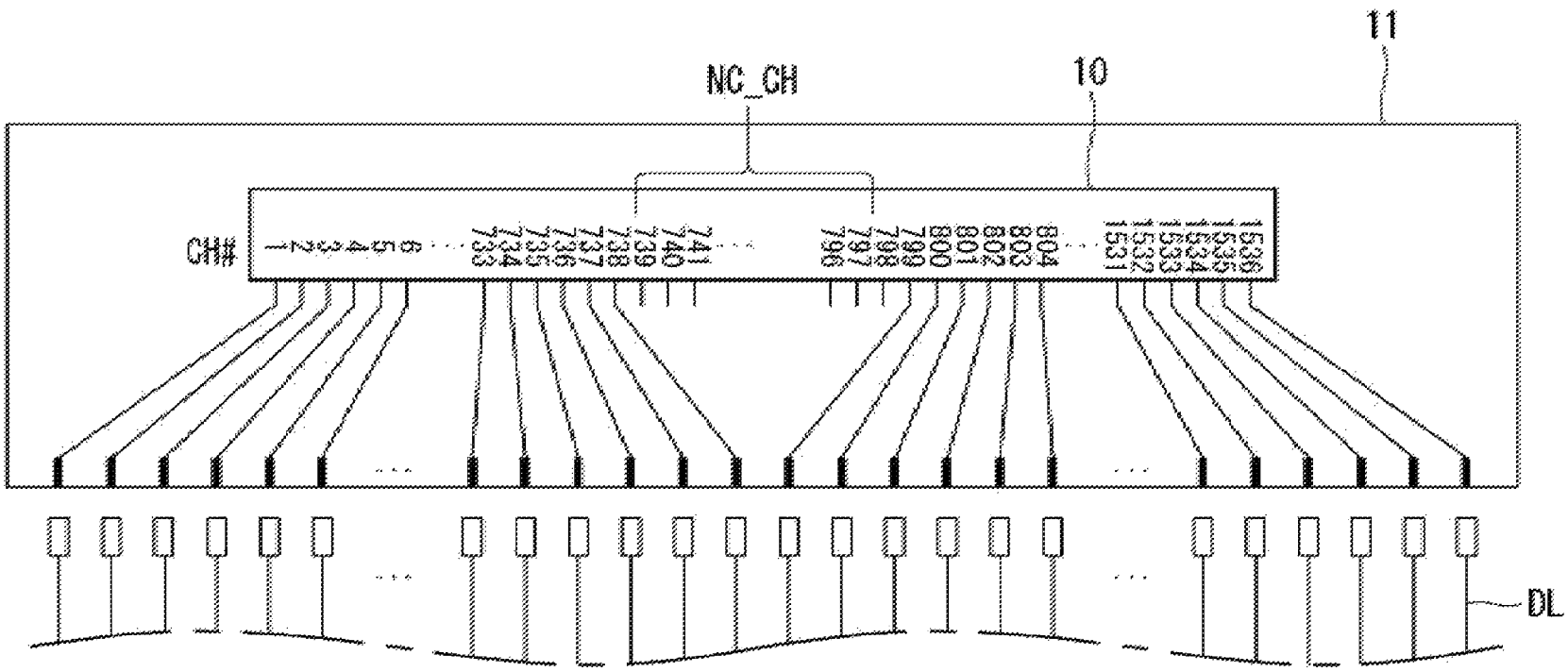
FIG. 5 is a plan view of a COF, which shows an ineffective channel section for one of the source driver ICs shown in FIG. 4.

FIG. 4 shows input and output signals of the timing controller 130 in an example where five source driver ICs SIC1 to SIC5 are connected to a display panel with a 2460×1200 resolution. FIG. 5 shows an ineffective channel section for one of the source driver ICs shown in FIG. 4.

Referring to FIGS. 4 and 5, with the horizontal resolution of 2460, the number of data lines on the display panel 100 is 2,460*3=7,380. Thus, if five source driver ICs SIC1 to SIC5 are connected to a display panel 100 with the horizontal resolution of 2460, the number of effective channels in each of the source driver ICs SIC1 to SIC5 is 1,476, and the total number of effective channels is 1,476*3=7,380. Since 1,476 effective channels are connected to 1,476 data lines, they supply red, green, and blue data simultaneously to 492 pixels.

The timing controller 130 sets 60 ineffective channels NC_CH in order to reduce the number of effective channels in each of the source driver ICs SIC1 to SIC5 from 1,536 to 1,476. In FIG. 5, NC_CH # denotes ineffective channel numbers. The timing controller 130 sets an ineffective channel section within a pulse of the second data enable signal DE_out, and adds dummy data for 60 channels to the ineffective channel section.

The timing controller 130 transmits pixel data for each source driver IC simultaneously to the source driver ICs SIC1 to SIC5, in synchronization with a pulse of the second data enable signal DE_out. The timing controller 130 transmits data to the source driver IC 10 so that the last pixel data is synchronized with the 1536th channel, which is the last channel of the source driver IC 10, for each pulse of the second data enable signal DE_out. In the example of FIGS. 4 and 5, an ineffective channel section is set between each effective channel section, but not limited thereto.

In FIG. 5, there are 60 ineffective channels NC_CH in the source driver IC 10 having 1,536 channels. The timing controller 130 can control the positions and number of ineffective channels by adding an ineffective channel section to each effective channel section during which pixel data is transmitted to the source driver IC 10 and transmitting dummy data during the ineffective channel section.

FIG. 6 is a waveform diagram showing input and output signals of the timing controller in an example where five source driver ICs are connected to a display panel with a 2416×1200 resolution.

Referring to FIG. 6, in a case where five source driver ICs SIC1 to SIC5 are connected to a display panel 100 with a horizontal resolution of 2416, the five source driver ICs SIC1 to SIC5 each are required to have 1,452 effective channels. Since 1,452 effective channels are connected to 1,452 data lines, they deal with 484 pixels.

The timing controller 130 sets 84 ineffective channels NC_CH by subtracting 1,452 from 1,536 in order to reduce the number of effective channels in each of the source driver ICs SIC1 to SIC5 from 1,536 to 1,452. The timing controller 130 sets an ineffective channel section within a pulse of the second data enable signal DE_out, and adds dummy data for 84 channels to the ineffective channel section.

The timing controller 130 transmits pixel data and dummy data to the first source driver IC SIC1 in synchronization with a first pulse of the second data enable signal DE_out, and transmits pixel data and dummy data to the second source driver IC SIC2 in synchronization with a second pulse of the second data enable signal DE_out. The last pixel data is synchronized with the 1536th channel, which is the last channel of the source driver IC 10, for each pulse of the second data enable signal DE_out.

Figure 7:
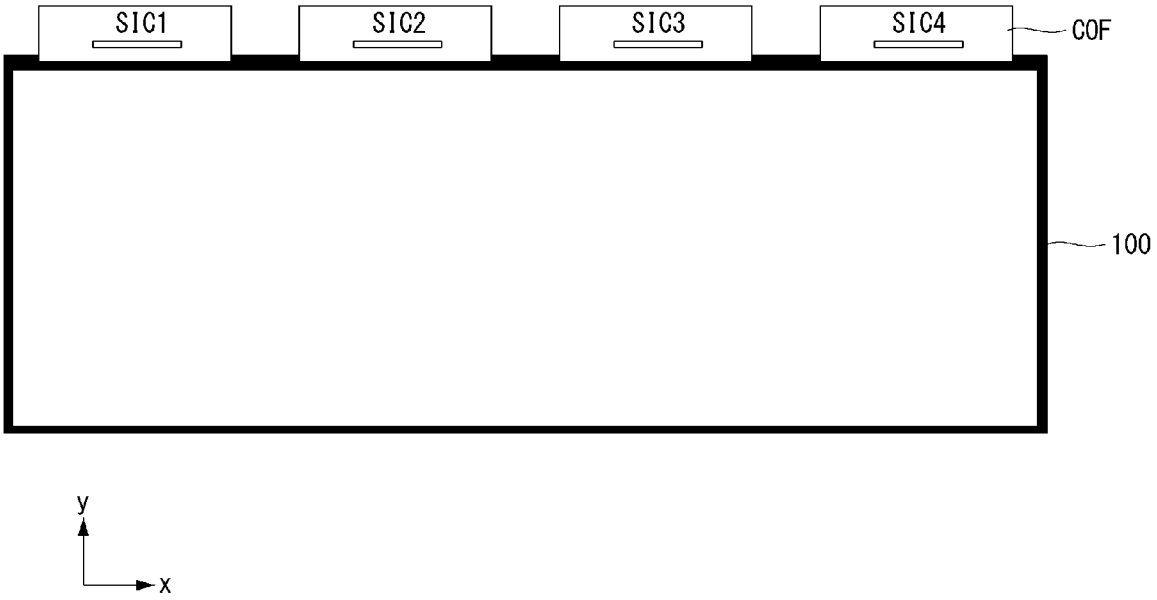
FIG. 7 is a view showing an example where four source driver ICs SIC1 to SIC4 are connected to a display panel.
Figure 8:
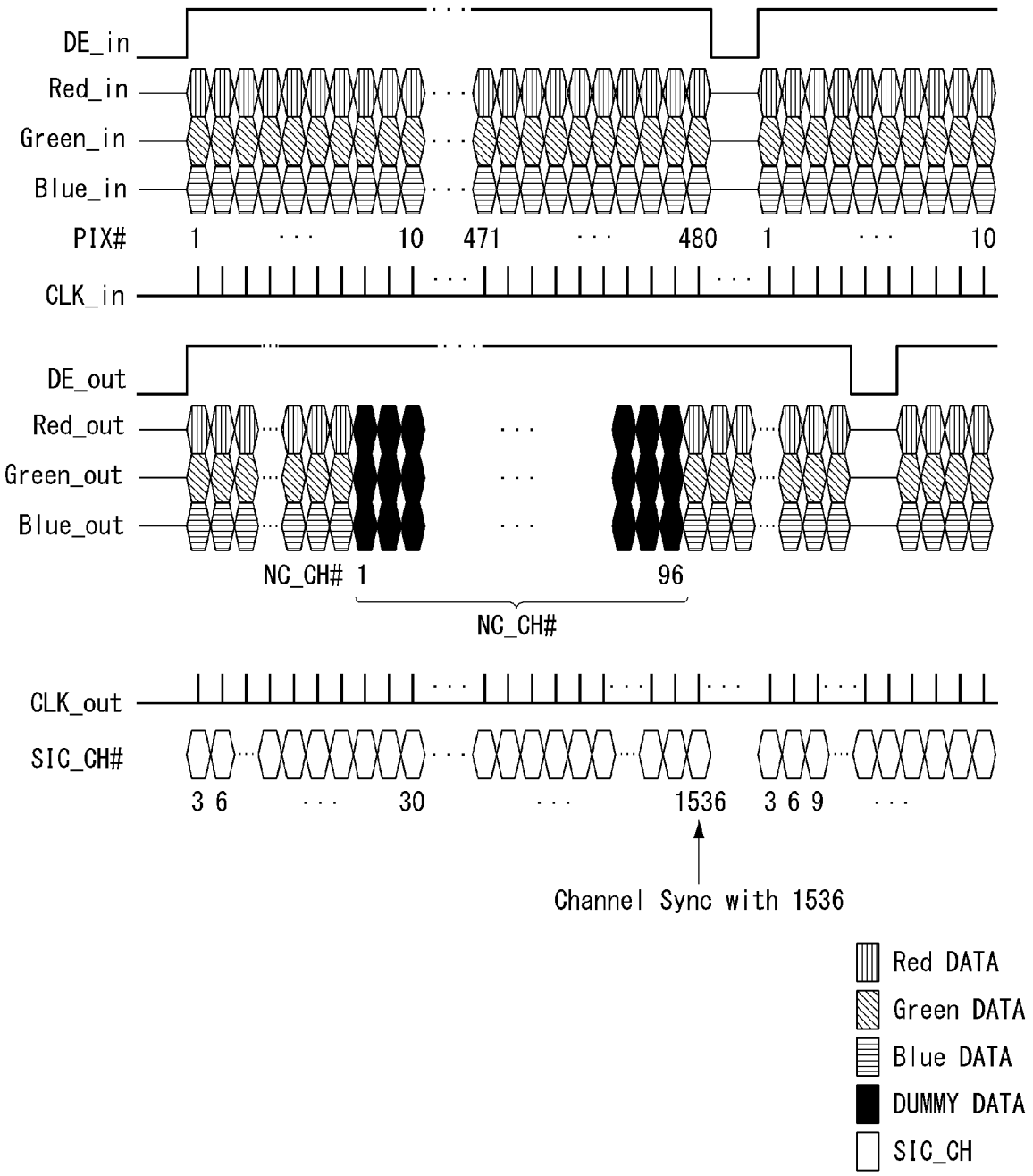
FIG. 8 is a waveform diagram showing input and output signals of a timing controller in an example where four source driver ICs are connected to a display panel with a 1920×1080 resolution.

FIG. 7 is a view showing an example where four source driver ICs SIC1 to SIC4 are connected to a display panel. FIG. 8 is a waveform diagram showing input and output signals of the timing controller 130 in an example where four source driver ICs SIC to SIC4 are connected to a display panel 100 with a 1920×1080 resolution.

Referring to FIGS. 7 and 8, in a case where four source driver ICs SIC1 to SIC4 are connected to a display panel 100 with a horizontal resolution of 1920, the four source driver ICs SIC1 to SIC4 each are required to have 1,440 effective channels. Since 1,440 effective channels are connected to 1,440 data lines, they deal with 480 pixels.

The timing controller 130 sets 96 ineffective channels NC_CH by subtracting 1,440 from 1,536 in order to reduce the number of effective channels in each of the source driver ICs SIC1 to SIC4 from 1,536 to 1,440. The timing controller 130 sets an ineffective channel section within a pulse of the second data enable signal DE_out, and adds dummy data for 96 channels to the ineffective channel section.

The timing controller 130 transmits pixel data and dummy data to the first source driver IC SIC1 in synchronization with a first pulse of the second data enable signal DE_out, and transmits pixel data and dummy data to the second source driver IC SIC2 in synchronization with a second pulse of the second data enable signal DE_out. The last pixel data is synchronized with the 1536th channel, which is the last channel of the source driver IC 10, for each pulse of the second data enable signal DE_out.

Although a pixel circuit of the present disclosure can be implemented as the circuit shown in FIG. 9, it is not limited to what is shown in FIG. 9 since any well-known circuit can be used. The pixel circuit shown in FIG. 9 is applicable to an external compensation circuit.

Referring to FIG. 9, the pixel circuit has an OLED, a driving element DT, switching elements M1 and M2, a capacitor Cst, etc. The driving element DT and the switching elements M1 and M2 can be implemented as transistors. In each of the sub-pixels 101, the pixel circuit is connected to one data line and one sensing line. The data line is connected to a data input node of the pixel circuit, and the sensing line is connected to a sensing node of the pixel circuit. The data input node is connected to the data line, and the sensing node is connected to the sensing line.

The OLED of the pixel circuit is a light-emitting element that emits light with an amount of current controlled by the gate-source voltage Vgs of the driving element DT. A current path of the OLED is switched by the second switching element M2 controlled by the EM signal EM. The OLED comprises an anode, a cathode, and an organic compound layer between the anode and the cathode. The organic compound layer can comprise, but is not limited to, a hole injection layer HIL, a hole transport layer HTL, an emission layer EML, an electron transport layer ETL, and an electron injection layer EIL. The anode of the OLED is connected to a third node n3, and the cathode of the OLED is connected to a VSS electrode supplied with a low-potential power voltage VSS. The VSS electrode can have, but not limited to, a lower potential voltage (e.g., 0 V) than a pixel driving voltage VDD.

The capacitor Cst is connected between a first node n1 and the third node n3 and stores the gate-source voltage Vgs of the driving element DT.

The first switching element M1 can be implemented as an n-channel TFT. If the first switching element M1, which has a long off period, is implemented as an n-type oxide TFT, leakage current is reduced in a slow driving mode, thereby improving power consumption and reducing flicker caused by leakage current.

The second and third switching elements M2 and M3 can be implemented as p-channel TFTs. P-channel LTPS (low temperature polysilicon) TFTs can increase driving efficiency and reduce power consumption because they have high charge mobility. The driving element DT can be implemented as an n-channel TFT or p-channel TFT.

The first switching element M1 supplies a reference voltage Vref from a sensing line to a second node n2, in response to a first scan signal SCAN1. The second switching element M2 switches the current flowing through the OLED in response to an EM signal EM. The third switching element M3 supplies a data voltage Vdata from a data line to the third node n3, in response to a second scan signal SCAN2. The first switching element M1 can switch the data voltage Vdata, and the third switching element M3 can switch the reference voltage Vref.

Figure 10A:
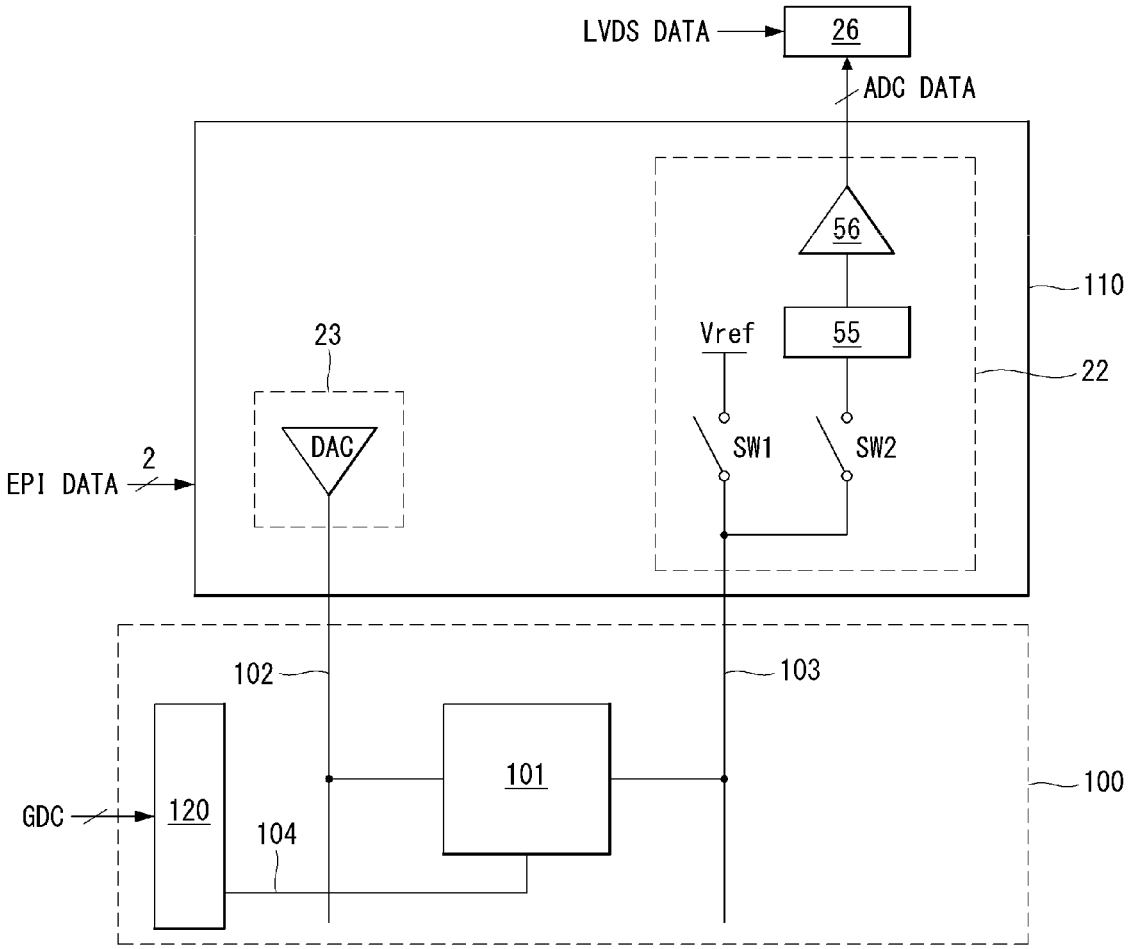
FIGS. 10A and 10B are views showing an external compensation circuit according to an example of the present disclosure.
Figure 10B:
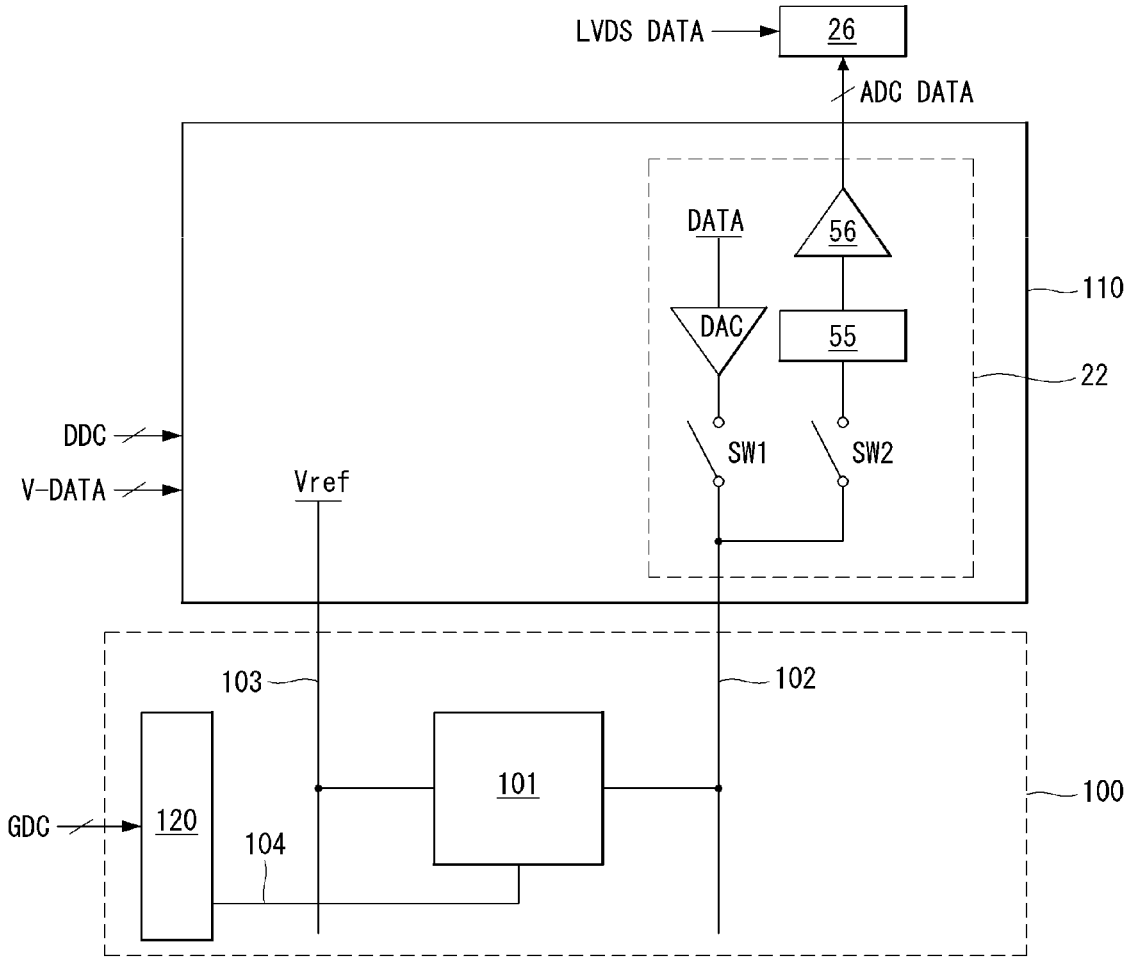

FIGS. 10A and 10B are views showing an external compensation circuit.

Referring to FIG. 10A, the external compensation circuit comprises a sensing part 22 and compensation part 26 that are connected to a sensing line 103. The sensing line 103 is connected to a pixel circuit of a sub-pixel 101.

The sensing part 22 comprises switching elements SW1 and SW2, a sample and hold circuit 55, an ADC 56, etc. The sensing part 22, along with a DAC 23, can be embedded in the data driver 110. The DAC 23 converts data received from the timing controller 130 into analog gamma-compensated voltages. The data voltages Vdata of pixel data outputted from the DAC 23 are outputted to a data line 102 through effective channels.

The sensing part 22 can sense the electrical characteristics of the driving element DT by sampling the current or voltage of the sensing line 103 that changes with the current flowing through the driving element DT. The sensing part 22 can be implemented as a well-known voltage sensing circuit or current sensing circuit. The first switching element SW1 supplies the sensing line 103 with a reference voltage Vref for resetting the sub-pixel 101 and the sensing line 103. The second switching element SW2 connects the sensing line 103 to the sample and hold circuit 55.

The sample and hold circuit 55 converts the current on the sensing line 103 to a voltage and samples the voltage, using an integrator, capacitor, switch, etc., or samples the voltage on the sensing line 103 and outputs the sampled voltage to the ADC 56. The ADC 56 converts the voltage inputted from the sample and hold circuit 55 to digital data ADC DATA and outputs it to the compensation part 26. The digital data ADC DATA contains information on the electrical characteristics of the driving element of each sub-pixel.

The compensation part 26 selects a compensation value from a lookup table according to the digital data ADC DATA received from the sensing part 22. The compensation part 26 compensates for changes in the electrical characteristics of each sub-pixel 101 over time or variations in electrical characteristics between sub-pixels 101 by modulating pixel data by adding the selected compensation value to the pixel data or multiplying the pixel data by the selected compensation value. The lookup table receives the ADC data from the sensing part 22 and the pixel data by an address and outputs the compensation value stored in that address. The pixel data modulated by the compensation part 26 is sent to the data driver 110 and converted to data voltages Vdata by the DAC 23.

The video data V-DATA modulated by the compensation part 26 is transmitted to the DAC 23. The modulated video data V-DATA is converted to data voltages for display by the DAC 23 and supplied to the first data line 102.

As shown in FIG. 10B, the sensing part 22 can supply data voltages Vdata to the data line 102 through the first switching element SW1. The reference voltage Vref is applied to the sub-pixel 101 through the sensing line 103.

Figure 11:
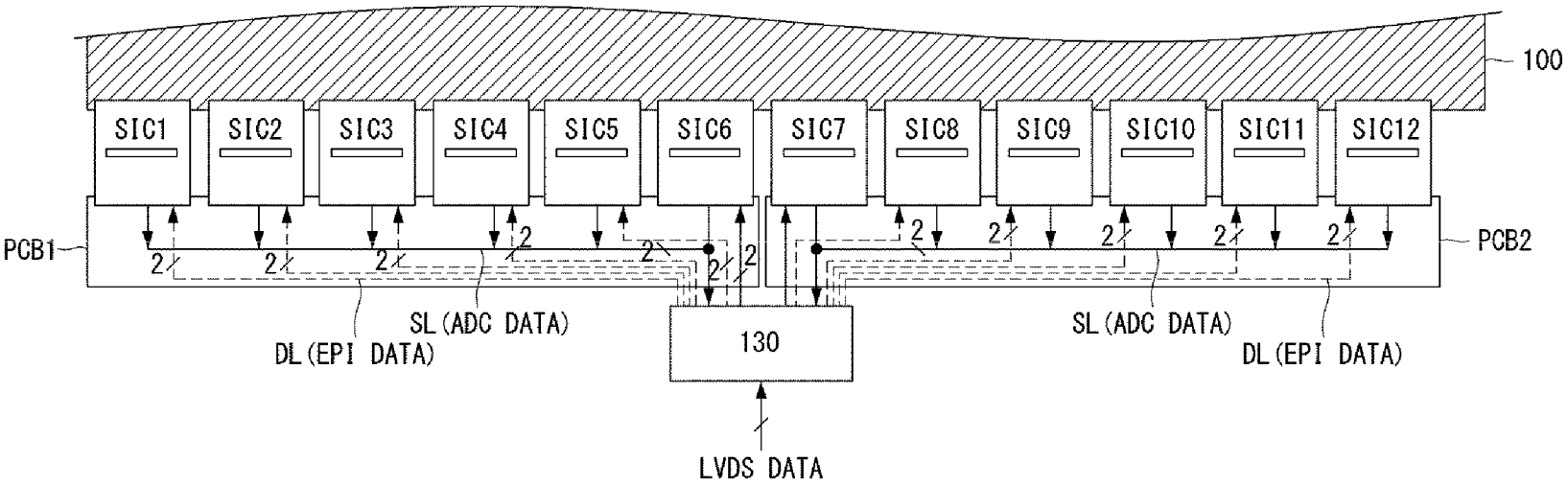
FIG. 11 is a view showing in detail wiring connections between the timing controller and the source driver ICs, in a display device to which the external compensation circuit is applied.

FIG. 11 is a view showing in detail wiring connections between the timing controller and the source driver ICs, in a display device to which the external compensation circuit is applied.

Referring to FIG. 11, the source driver ICs SIC1 to SIC12 receive data from the timing controller 130 via an EPI interface.

The EPI interface minimizes the number of wires between the timing controller 130 and the source driver ICs SIC1 to SIC12 by connecting the timing controller 130 and the source driver ICs SIC1 to SIC12 in a point-to-point manner—that is, on a one-to-one basis. The EPI interface has no clock wires connected between the timing controller 130 and the source driver ICs SIC1 to SIC12.

The EPI interface protocol is explained in detail in Korean Laid Open Patent Publications No. 10-2010-0068936 and No 10-2010-0068938 filed by the present applicant, where these publications are incorporated by reference into the present application.

The timing controller 130 sends clock-containing data EPI DATA to the source driver ICs SIC1 to SIC12 by a differential signal by an encoding method prescribed in the EPI interface protocol. Thus, pairs of EPI data wires [DL (EPI DATA)] for transmitting a differential signal are connected between the timing controller 130 and the source driver ICs SIC1 and SIC12.

A clock recovery circuit for CDR (clock and data recovery) is embedded in each of the source driver ICs SIC1 to SIC12. The timing controller 130 transmits a clock training pattern or preamble signal to each of the source driver ICs SIC1 to SIC12 so that the phase and frequency of the clock recovered by the clock recovery circuit of the source driver IC can be locked. The clock recovery circuits of the source driver ICs SIC1 to SIC12 recover the clock from the data of the differential signal received via the pairs of EPI data wires [DL(EPI DATA)].

In the EPI interface protocol, the timing controller 130 transmits a preamble signal to the source driver ICs SIC1 to SIC12 before sending control data and the pixel data of input image. The control data comprises data timing control information and gate timing control information. The clock recovery circuits of the source driver ICs SIC1 to SIC12 lock the phase and frequency of the internal clock to a stable state by performing a clock training (CT) operation in accordance with the preamble signal. Once the phase and frequency of the internal clock are locked to a stable state, data links for data transmission are established between the source driver ICs SIC1 to SIC12 and the timing controller 130. After receiving a lock signal LOCK of high logic level from the last source driver IC SIC, the timing controller 130 starts to encode the control data and the video data into data packets defined in the EPI interface protocol and transmit them to the source driver ICs SIC1 to SIC12.

When the output phase and frequency of the clock recovery circuit embedded in any one of the source driver ICs SIC1 to SIC12 are unlocked, the lock signal LOCK is inverted to low logic level, and the last source driver IC SIC12 transmits the inverted lock signal to the timing controller 130. Once the lock signal is inverted to low logic signal, the timing controller 130 restarts the clock training of the source driver ICs by transmitting a preamble signal to the source driver ICs SIC1 to SIC12.

The timing controller 130 and the source driver ICs SIC1 to SIC12 are connected via the pairs of EPI data wires [DL(EPI DATA)], and are also connected via pairs of ADC data wires [SL(ADC DATA)]. The pairs of EPI data wires [DL(EPI DATA)] can connect the timing controller 130 and the source driver ICs SIC1 to SIC12 in a point-to-point manner.

The pairs of ADC data wires [SL(ADC DATA)] connect the timing controller 130 to the source driver ICs SIC1 to SIC12 in parallel. The pairs of ADC data wires [SL(ADC DATA)] connect the timing controller 130 to ADC effective data channels of the source driver ICs SIC1 to SIC12. The source driver ICs SIC1 to SIC12 transmit the ADC data outputted from the ADC 56 of the sensing part 22 to the timing controller 130.

The source driver ICs SIC1 to SIC6 connected to a first PCB PCB1 can be connected in parallel to the timing controller 130 via first pairs of ADC data wires [SL(ADC DATA)]. The source driver ICs SIC7 to SIC12 connected to a second PCB PCB2 can be connected in parallel to the timing controller 130 via second pairs of ADC data wires [SL(ADC DATA)]. Since the source driver ICs SIC1 to SIC12 are connected in parallel to the timing controller 130, the source driver ICs SIC1 to SIC12 sequentially transmit ADC data to the timing controller 130.

Figure 12:
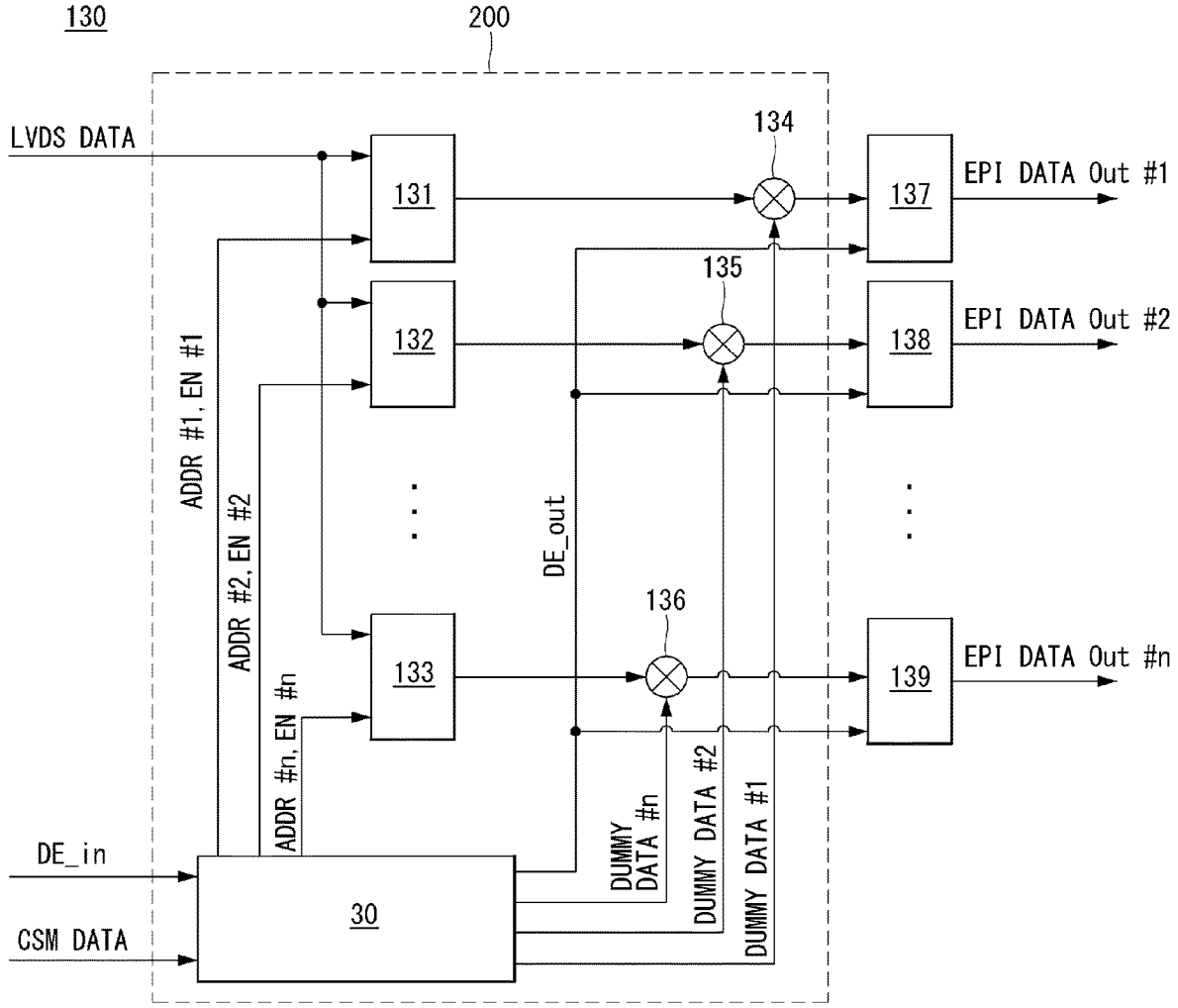
FIG. 12 is a circuit diagram showing the ineffective channel controller according to a first exemplary embodiment of the present disclosure.

As shown in FIG. 12, the timing controller 130 can comprise an ineffective channel controller 200 that sets an ineffective channel section for each source driver IC.

Referring to FIG. 12, the ineffective channel controller 200 can be embedded in the timing controller 130 but not limited thereto. For example, the ineffective channel controller 132 can be implemented as a separate circuit connected to the timing controller 130.

The ineffective channel controller 200 comprises a plurality of memories 131 to 133, a memory controller 30, data combiners 134 to 136, and data transmitter 137 to 139.

The memories 131 to 133 store pixel data to be transmitted to the source driver ICs. Each of the memories 131 to 133 is enabled by an enable signal from the memory controller 30 and stores pixel data LVDS DATA received from the host system 150. The pixel data LVDS DATA is written to a memory region (address) indicated by an address signal received from the memory controller 30.

The first memory 131 stores pixel data to be transmitted to the effective channels in the first source driver IC SIC1, in response to a first enable signal EN #1 and first address signal ADDR #1 received from the memory controller 30. The second memory 132 stores pixel data to be transmitted to the effective channels in the second source driver IC SIC2, in response to a second enable signal EN #2 and second address signal ADDR #2 received from the memory controller 30. The nth memory 133 stores pixel data to be transmitted to the effective channels in the nth source driver IC SICn, in response to an nth enable signal EN #n and nth address signal ADDR #n received from the memory controller 30.

The data combiners 134 to 136 combine pixel data read from the memories 131 to 133 and dummy data from the memory controller 30, under control of the memory controller 30. The first data combiner 134 adds dummy data, along with pixel data from the first memory 131, to the ineffective channel section of the first source driver IC SIC1 and outputs it to the first data transmitter 137. The second data combiner 135 adds dummy data, along with pixel data from the second memory 132, to the ineffective channel section of the second source driver IC SIC2 and outputs it to the second data transmitter 138. The nth data combiner 136 adds dummy data, along with pixel data received from the nth memory 133, to the ineffective channel section of the nth source driver IC SICn and outputs it to the nth data transmitter 139.

The first data transmitter 137 converts data received from the first data combiner 134 to serial data and outputs the serial data as a pair of differential signals. The pair of differential signals outputted from the first data transmitter 137 are transmitted to the first source driver IC SIC1 via a first pair of EPI data wires during a first pulse period of the second data enable signal DE_out. The second data transmitter 138 converts data received from the second data combiner 135 to serial data and outputs the serial data as a pair of differential signals. The pair of differential signals outputted from the second data transmitter 138 are transmitted to the second source driver IC SIC2 via a second pair of EPI data wires during a second pulse period of the second data enable signal DE_out. The nth data transmitter 139 converts data received from the nth data combiner 136 to serial data and outputs the serial data as a pair of differential signals. The pair of differential signals outputted from the nth data transmitter 139 are transmitted to the nth source driver IC SICn via an nth pair of EPI data wires during an nth pulse period of the second data enable signal DE_out.

The memory controller 30 generates separate enable signals EN #1 to EN # n for the memories 131 to 133 to control the read/write timings of each memory. Also, the memory controller 30 generates separate address signals ADDR #1 to ADDR # n for the source driver ICs to define an effective channel section but exclude the ineffective channel section for the source driver ICs defined by the CSM data. The CSM data defines an ineffective channel section by the starting position and width of the ineffective channel section of each source driver IC.

The memory controller 30 transmits dummy data preset for the ineffective channel section of each source driver IC to the data combiners 134 to 136. The memory controller 30 transmits the second data enable signal DE_out to the data transmitters 137 to 139 to control the data output timings of the data transmitters 137 to 139.

The number of effective channels among all ADC data channels of each source driver IC can be changed. In this case, among the ADC data channels, the ineffective channels (hereinafter, referred to as "ADC ineffective channels") can be set up, but not the effective channels (hereinafter, referred to as "ADC effective channels"). The ADC effective channels are connected to sensing lines 103. On the contrary, the ADC ineffective channels are not connected to the sensing lines 103.

Figure 13:
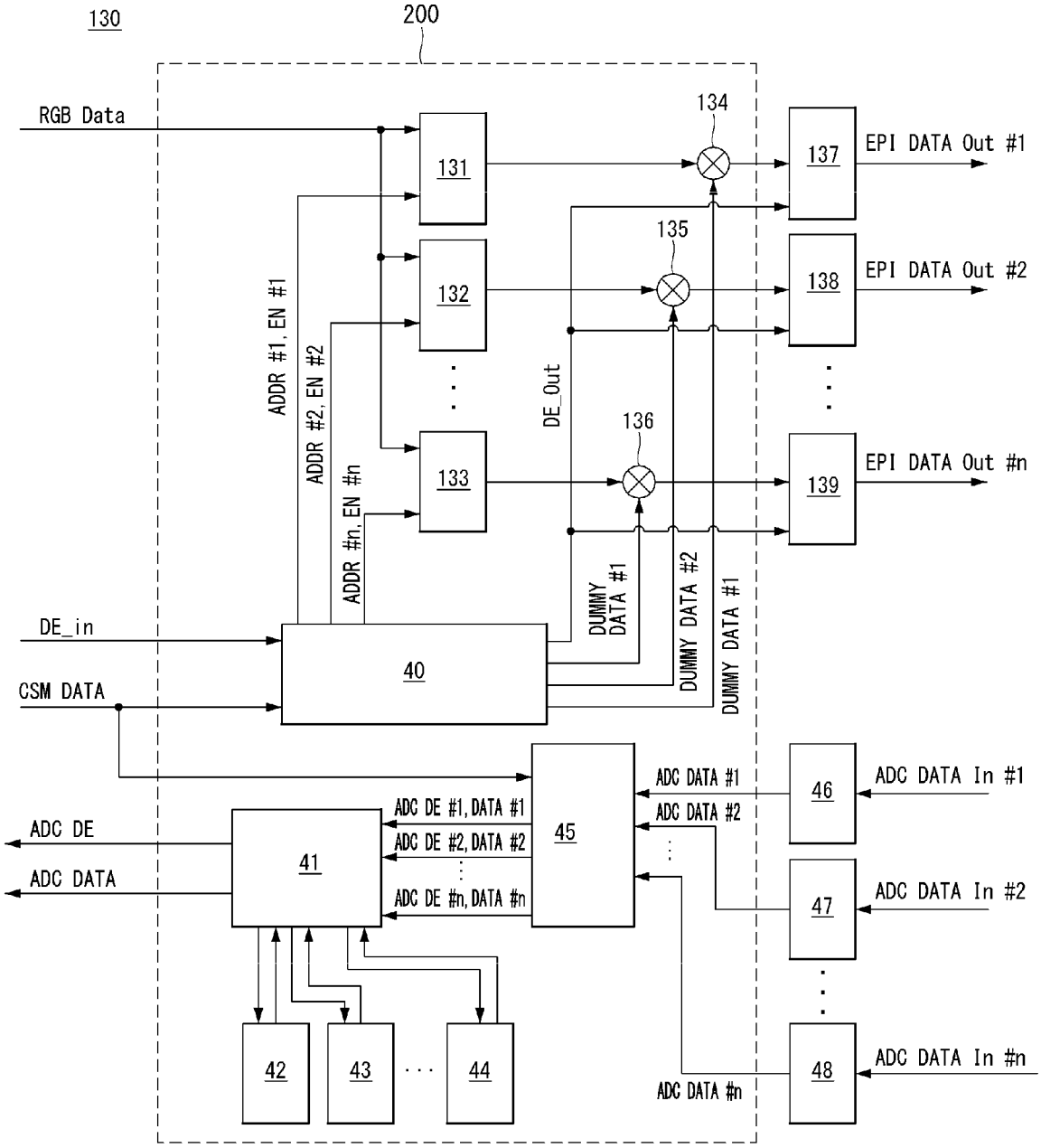
FIG. 13 is a circuit diagram showing the ineffective channel controller according to a second exemplary embodiment of the present disclosure.
Figure 14:
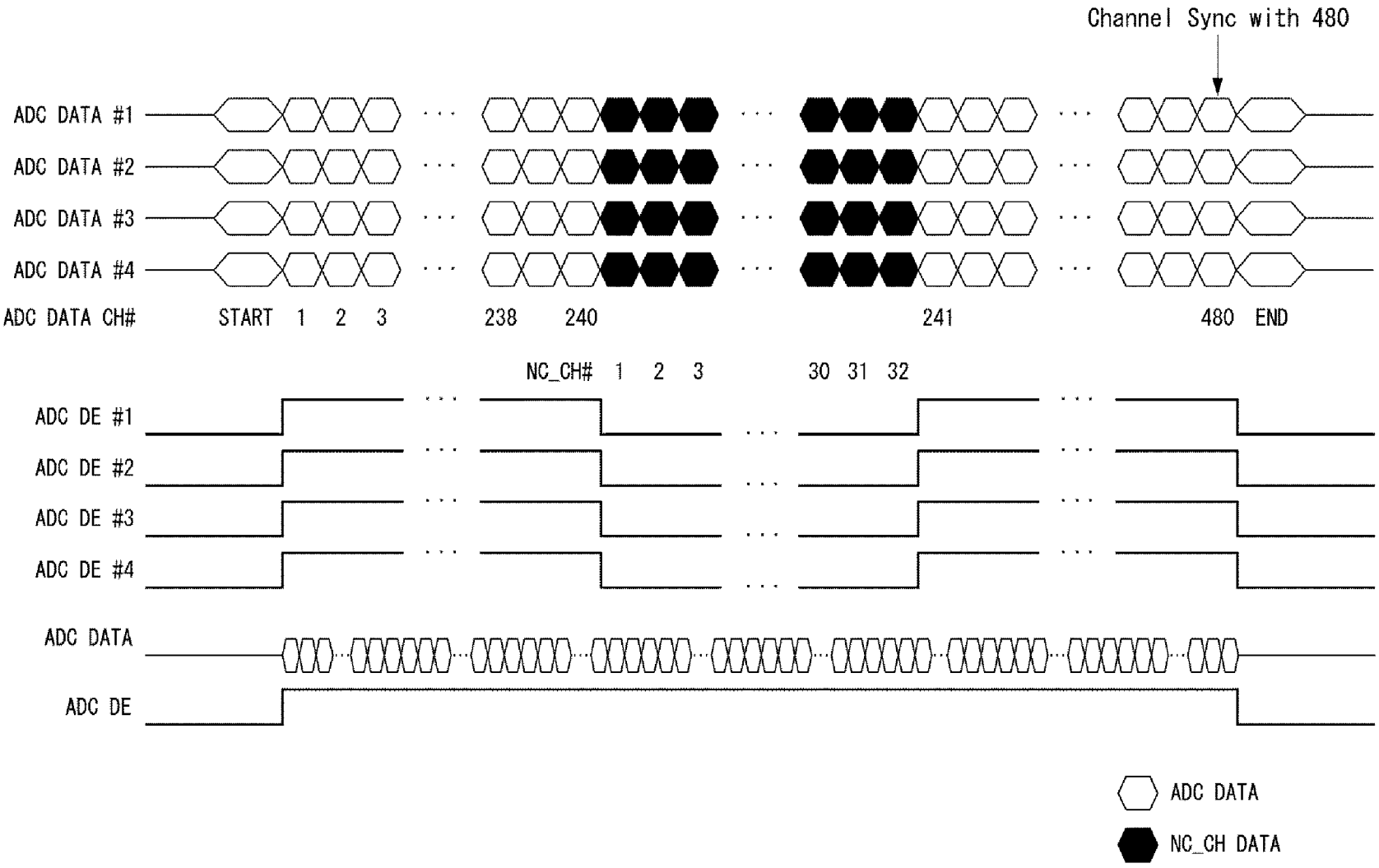
FIG. 14 is a waveform diagram showing an example of an ineffective channel section among ADC (analog-to-digital converter) data channels.

FIG. 13 shows the ineffective channel controller 200 which controls ineffective channel section among ADC data channels. FIG. 14 is a waveform diagram showing an example of an ineffective channel section among ADC data channels.

Referring to FIGS. 13 and 14, the ineffective channel controller 200 comprises a first ineffective channel portion for setting an ineffective channel section (hereinafter, "source ineffective channel section") among pixel data channels, and a second ineffective channel portion for setting an ADC ineffective channel section among ADC data channels. CSM data is inputted to the first and second ineffective channel portions. The CSM data defines the source ineffective channel section and the ADC ineffective channel section by their starting positions and widths. The CSM data can be updated to change the source ineffective channel section and the ADC ineffective channel section.

The first ineffective channel portion comprises memories 131 to 133, a first memory controller 40, data combiners 134 to 136, and data transmitters 137 to 139. The first ineffective channel portion is substantially identical to the ineffective channel controller shown in FIG. 12, so a detailed description thereof will be omitted. The first memory controller 40 controls address signals for the memories 131 to 133 where pixel data for each source driver IC is stored, and controls the memories 133, the data combiners 134 to 136, and the data transmitters 137 to 139 so that dummy data is added to the source ineffective channel section.

The second ineffective channel portion comprises a plurality of data receivers 46 to 48, an ADC effective data checking part 45, and a plurality of memories 42 to 44.

In the example of FIG. 13, ADC DATA #1 to #4 are ADC data the ineffective channel controller 200 receives from each source driver IC. ADC DATA CH # denotes ADC data channel numbers. The ADC data are ADC effective channel data the ineffective channel controller 200 stores in the memories 42 to 44.

The first ADC data ADC DATA #1 is generated from the first to 480th ADC data channels of the first source driver IC SIC1. The second ADC data ADC DATA #2 is generated from the first to 480th ADC data channels of the second source driver IC SIC2. 32 ADC ineffective channels NC_CH DATA between the 240th data and 241th data of each ADC data ADC DATA #1 To #4 are transmitted to the ineffective channel transmitter 200.

The data receivers 46 to 48 receive ADC data for each source driver IC. The first data receiver 46 receives first ADC data ADC DATA #1 from the first source driver IC SIC1 via a pair of ADC data wires. The second data receiver 47 receives second ADC data ADC DATA #2 from the second source driver IC SIC2 via a pair of ADC data wires. The nth data receiver 48 receives nth ADC data ADC DATA # n from the nth source driver IC SICn via a pair of ADC data wires. The ADC data ADC DATA #1 to # n can be time-divided and transmitted to the ineffective channel transmitter 200 via a pair of ADC data wires.

The ADC effective data checking part 45 receives CSM data, selects ADC data from the ADC effective channels but excludes the ineffective channel section indicated by the CSM data, and supplies it to a second memory controller 41. In order to store the ADC data from the ADC effective channels for each source driver IC in the memories 42 to 44, the ADC effective data checking part 45 separates an ADC data enable signal ADC DE #1 to # n and the ADC data from each other for each memory.

The second memory controller 41 generates an enable signal and an address signal for each individual memory, in response to an ADC data enable signal from the ADC effective data checking part 45, in order to control the memories 42 to 44 individually. The second memory controller 41 generates a first ADC memory enable signal for controlling read and write operations on the first memory 42 and a first ADC data address signal, in response to a first ADC data enable signal from the ADC effective data checking part 45. The second memory controller 41 generates a second ADC memory enable signal for controlling read and write operations on the second memory 43 and a second ADC data address signal, in response to a second ADC data enable signal from the ADC effective data checking part 45. The nth memory controller **4*n* generates an nth ADC memory enable signal for controlling read and write operations on the nth memory 44 and an nth ADC data address signal, in response to an nth ADC data enable signal from the effective data checking part 45**.

The first memory 42 is enabled by the first ADC memory enable signal and stores ADC data, received from the ADC effective channels in the first source driver IC SIC1, in a memory region indicated by the first ADC data address signal. The second memory 43 is enabled by the second ADC memory enable signal and stores ADC data, received from the ADC effective channels in the second source driver IC SIC2, in a memory region indicated by the second ADC data address signal. The nth memory 44 is enabled by the nth ADC memory enable signal and stores ADC data, received from the ADC effective channels in the nth source driver IC SICn, in a memory region indicated by the nth ADC data address signal. The ADC data stored in the memories 42 to 44 is provided to the compensation part 26.

As described previously, the present disclosure can vary the number of channels in a driver IC without the need to add a circuit for adjusting the number of channels and optional pins to the driver IC, since an ineffective channel controller of a channel control unit sets an ineffective channel section, adds dummy data to the ineffective channel section, and sends the dummy data to the driver IC.

The present disclosure allows for selecting only ADC data from ADC effective channels, but not from ADC ineffective channels, by receiving channel data that defines ADC ineffective channels which are not connected to sensing lines, among ADC data channels for outputting ADC data containing information on the electrical characteristics of each pixel. Consequently, the present disclosure can vary the number of channels in a driver IC without the need to add a circuit for adjusting the number of channels and optional pins to the driver IC.

A channel control unit and a display device using the channel control unit according to various embodiments of the disclosure can be described as follows.

A channel control unit according to embodiments of the disclosure includes a data driver configured to convert pixel data into data voltages and supplies the data voltages to data lines, and an ineffective channel controller configured to receive channel data, generate dummy data during an ineffective channel section indicated by the channel data, and send the dummy data and the pixel data to the data driver.

The channel data define the starting position and width of the ineffective channel section.

The data driver comprises one or more source driver ICs. The source driver ICs each includes ineffective channels defined by the channel data, Effective channels of the source driver ICs are connected to the data lines, and the ineffective channels of the source driver ICs are separated from the data lines.

The ineffective channel controller receives a first data enable signal and generates a second data enable signal whose pulse width varies by an amount equal to the ineffective channel section defined by the channel data.

The ineffective channel controller includes a first memory configured to receive a first enable signal and a first address signal and store the pixel data to be sent to the first source driver IC in a first address, a second memory configured to receive a second enable signal and a second address signal and store the pixel data to be sent to the second source driver IC in a second address, a memory controller configured to generate the enable signals and the address signals and outputs the dummy data to the ineffective channel section indicated by the channel data, a first data combiner configured to combine the pixel data from the first memory and the dummy data, a second data combiner configured to combine the pixel data from the second memory and the dummy data, a first data transmitter configured to transmit the data received from the first data combiner to the first source driver IC during a first pulse period of the second data enable signal, and a second data transmitter configured to transmit the data received from the second data combiner to the second source driver IC during a second pulse period of the second data enable signal.

The data driver further includes ADC effective channels that output ADC data. The ADC data is generated by converting signals received from sensing lines connected to sensing nodes of pixels to digital data, The channel data defines the ADC effective channels but excludes an ADC ineffective channel section, and the ineffective channel controller selects the ADC data received from the ADC effective channels in response to the channel data.

The data driver comprises one or more source driver ICs. The source driver ICs each includes one or more ADC ineffective channels belonging to the ADC ineffective channel section; and the ADC effective channels. The ADC effective channels of the source driver ICs are connected toe sensing lines, and the ADC ineffective channels of the source driver ICs are separated from the sensing lines.

The channel data defines the starting positions and widths of the source ineffective channel section and ADC ineffective channel section.

The data driver comprises first and second source driver ICs. The ineffective channel controller includes a first memory configured to receive a first enable signal and a first address signal and stores the pixel data to be sent to the first source driver IC in a first address, a second memory configured to receive a second enable signal and a second address signal and stores the pixel data to be sent to the second source driver IC in a second address, a first memory controller configured to generate the enable signals and the address signals and outputs the dummy data to the ineffective channel section indicated by the channel data, a first data combiner configured to combine the pixel data from the first memory and the dummy data, a second data combiner configured to combine the pixel data from the second memory and the dummy data, a first data transmitter configured to transmit the data received from the first data combiner to the first source driver IC during a first pulse period of the second data enable signal, and a second data transmitter configured to transmit the data received from the second data combiner to the second source driver IC during a second pulse period of the second data enable signal, a first data receiver configured to receive the ADC data from the first source driver IC, a second data receiver configured to receive the ADC data from the second source driver IC, an ADC effective data checking part configured to select the ADC data received from the ADC effective channels, and a second memory controller configured to store the ADC data from the ADC effective channels of the first and second source driver ICs.

A display device according to embodiments of the disclosure includes data lines connected to pixels to which a pixel data is written, a data driver that converts the pixel data into data voltages and supplies the data voltages to data lines; and, an ineffective channel controller that receives channel data, generates dummy data during an ineffective channel section indicated by the channel data, and sends the dummy data and the pixel data to the data driver.

The data driver includes one or more ineffective channels separated from the data lines, and effective channels connected to the data lines.

The ineffective channel controller receives a first data enable signal and generates a second data enable signal whose pulse width varies by an amount equal to the ineffective channel section defined by the channel data.

The display device further includes sensing lines connected to sensing nodes of the pixels. The data driver further includes ADC effective channels through which ADC data, generated by converting signals received from the sensing lines to digital data, is outputted. The channel data defines the ADC effective channels but excludes an ADC ineffective channel section, and the ineffective channel controller selects the ADC data received from the ADC effective channels in response to the channel data.

A display device according to embodiments of the disclosure a display panel where a plurality of data lines are arranged, a data driver comprising effective channels electrically connected to the data lines and ineffective channels separated from the data lines, and a timing controller configured to send a pixel data to the effective channels and sends dummy data to the ineffective channels.

The timing controller includes an ineffective channel controller configured to receive channel data, generate dummy data during an ineffective channel section indicated by the channel data, and send the dummy data and the pixel data to the data driver.

The channel data defines the starting position and width of the ineffective channel section.

The effective channels are connected to the data lines, and the ineffective channels are separated from the data lines.

The display device further includes sensing lines connected to sensing nodes of the pixels. The data driver further comprises ADC effective channels that output ADC data. The ADC data is generated by converting signals received from the sensing lines to digital data.

The channel data defines the ADC effective channels but excludes an ADC ineffective channel section, and the ineffective channel controller selects the ADC data received from the ADC effective channels in response to the channel data.

The ADC effective channels are connected to the sensing lines, and ADC ineffective channels belonging to the ADC ineffective channel section are separated from the sensing lines.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A channel control unit comprising:

a data driver configured to convert pixel data into data voltages, and supply the data voltages to data lines, and an ineffective channel controller configured to receive channel data, generate dummy data in an ineffective channel section indicated by the channel data, and send the dummy data and the pixel data to the data driver, wherein the data driver comprises one or more source driver integrated circuits (ICs), each comprising ineffective channels defined by the channel data, wherein the ineffective channel controller receives a first data enable signal, and generates a second data enable signal, wherein the second data enable signal is changed when the ineffective channels are changed by a variation of the ineffective channel section, wherein the ineffective channel section is defined based on a horizontal resolution of a display panel, wherein a pulse width of the second data enable signal includes the dummy data and the pixel data, wherein the pulse width of the second data enable signal is increased by an amount of the dummy data that is included, and wherein the pulse width of the second data enable signal varies by an amount equal to the ineffective channel section defined by the channel data.

2. The channel control unit of claim 1, wherein the channel data defines a starting position and a width of the ineffective channel section.

3. The channel control unit of claim 1, wherein effective channels of the source driver ICs are connected to the data lines, and the ineffective channels of the source driver ICs are separated from the data lines.

4. The channel control unit of claim 1, wherein the ineffective channel controller comprises:

a first memory configured to receive a first enable signal and a first address signal, and store the pixel data to be sent to the first source driver IC in a first address;

a second memory configured to receive a second enable signal and a second address signal, and store the pixel data to be sent to the second source driver IC in a second address;

a memory controller configured to generate the enable signals and the address signals, and output the dummy data to the ineffective channel section indicated by the channel data;

a first data combiner configured to combine the pixel data from the first memory and the dummy data;

a second data combiner configured to combine the pixel data from the second memory and the dummy data;

a first data transmitter configured to transmit the data received from the first data combiner to the first source driver IC during a first pulse period of the second data enable signal; and a second data transmitter configured to transmit the data received from the second data combiner to the second source driver IC during a second pulse period of the second data enable signal.

5. The channel control unit of claim 1, wherein the data driver further comprises analog-to-digital converter (ADC) effective channels that output ADC data, wherein the ADC data is generated by converting signals received from sensing lines connected to sensing nodes of pixels to digital data, wherein the channel data defines the ADC effective channels but excludes an ADC ineffective channel section, and the ineffective channel controller selects the ADC data received from the ADC effective channels in response to the channel data.

6. The channel control unit of claim 5, wherein the data driver comprises one or more source driver integrated circuits (ICs), the source driver ICs each comprising:

one or more ADC ineffective channels belonging to the ADC ineffective channel section; and the ADC effective channels, wherein the ADC effective channels of the source driver ICs are connected to sensing lines, and the ADC ineffective channels of the source driver ICs are separated from the sensing lines.

7. The channel control unit of claim 5, wherein the channel data defines starting positions and widths of the source ineffective channel section and ADC ineffective channel section.

8. The channel control unit of claim 5, wherein the data driver comprises first and second source driver integrated circuits (ICs), and the ineffective channel controller comprises:

a first memory configured to receive a first enable signal and a first address signal, and store the pixel data to be sent to the first source driver IC in a first address;

a second memory configured to receive a second enable signal and a second address signal, and store the pixel data to be sent to the second source driver IC in a second address;

a first memory controller configured to generate the enable signals and the address signals, and output the dummy data to the ineffective channel section indicated by the channel data;

a first data combiner configured to combine the pixel data from the first memory and the dummy data;

a second data combiner configured to combine the pixel data from the second memory and the dummy data;

a first data transmitter configured to transmit the data received from the first data combiner to the first source driver IC during a first pulse period of the second data enable signal;

a second data transmitter configured to transmit the data received from the second data combiner to the second source driver IC during a second pulse period of the second data enable signal;

a first data receiver configured to receive the ADC data from the first source driver IC;

a second data receiver configured to receive the ADC data from the second source driver IC;

an ADC effective data checking part configured to select the ADC data received from the ADC effective channels; and a second memory controller configured to store the ADC data from the ADC effective channels of the first and second source driver ICs.

9. A display device comprising:

data lines connected to pixels to which pixel data is written;

a data driver that converts the pixel data into data voltages and supplies the data voltages to data lines; and an ineffective channel controller that receives channel data, generates dummy data in an ineffective channel section indicated by the channel data, and sends the dummy data and the pixel data to the data driver, wherein the data driver comprises one or more ineffective channels and effective channels, wherein the ineffective channel controller receives a first data enable signal, and generates a second data enable signal, wherein the second data enable signal is changed when the ineffective channels are changed by a variation of the ineffective channel section, wherein the ineffective channel section is defined based on a horizontal resolution of a display panel, wherein a pulse width of the second data enable signal includes the dummy data and the pixel data, and wherein the pulse width of the second data enable signal is increased by an amount of the dummy data that is included, and wherein the pulse width of the second data enable signal varies by an amount equal to the ineffective channel section defined by the channel data.

10. The display device of claim 9, wherein the ineffective channels are separated from the data lines; and the effective channels are connected to the data lines.

11. The display device of claim 9, further comprising sensing lines connected to sensing nodes of the pixels, wherein the data driver further comprises analog-to-digital converter (ADC) effective channels through which ADC data, generated by converting signals received from the sensing lines to digital data, is outputted, and wherein the channel data defines the ADC effective channels but excludes an ADC ineffective channel section, and the ineffective channel controller selects the ADC data received from the ADC effective channels in response to the channel data.

12. A display device comprising:

a display panel where a plurality of data lines are arranged;

a data driver comprising effective channels electrically connected to the data lines and ineffective channels separated from the data lines; and a timing controller configured to send pixel data to the effective channels and send dummy data to the ineffective channels, and including an ineffective channel controller configured to receive a first data enable signal, generate a second data enable signal, receive channel data, generate dummy data in an ineffective channel section indicated by the channel data, and send the dummy data and the pixel data to the data driver, wherein the channel data is changed when the dummy data is changed by a variation of the ineffective channel section, wherein the ineffective channel section is defined based on a horizontal resolution of the display panel, wherein a pulse width of the second data enable signal includes the dummy data and the pixel data, wherein the pulse width of the second data enable signal is increased by an amount of the dummy data that is included, and wherein the pulse width of the second data enable signal varies by an amount equal to the ineffective channel section defined by the channel data.

13. The display device of claim 12, wherein the channel data defines a starting position and a width of the ineffective channel section.

14. The display device of claim 12, wherein the effective channels are connected to the data lines, and the ineffective channels are separated from the data lines.

15. The display device of claim 12, further comprising sensing lines connected to sensing nodes of the pixels, wherein the data driver further comprises analog-to-digital converter (ADC) effective channels that output ADC data, wherein the ADC data is generated by converting signals received from the sensing lines to digital data.

16. The display device of claim 15, wherein the channel data defines the ADC effective channels but excludes an ADC ineffective channel section, and the ineffective channel controller selects the ADC data received from the ADC effective channels in response to the channel data.

17. The display device of claim 16, wherein the ADC effective channels are connected to the sensing lines, and ADC ineffective channels belonging to the ADC ineffective channel section are separated from the sensing lines.

* * * * *